US008342635B2

(12) United States Patent
Sasaki et al.

(10) Patent No.: US 8,342,635 B2
(45) Date of Patent: Jan. 1, 2013

(54) INKJET RECORDING APPARATUS AND RECORDING MEDIUM CONVEYANCE METHOD FOR THE INKJET RECORDING APPARATUS

(75) Inventors: Megumi Sasaki, Fujisawa (JP); Yoshitsugu Sohara, Tokyo (JP); Hideaki Matsumura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 260 days.

(21) Appl. No.: 12/839,263

(22) Filed: Jul. 19, 2010

(65) Prior Publication Data

US 2011/0018926 A1 Jan. 27, 2011

(30) Foreign Application Priority Data

Jul. 24, 2009 (JP) ..... 2009-172919

(51) Int. Cl.
*B41J 29/38* (2006.01)

(52) U.S. Cl. ..... 347/16

(58) Field of Classification Search ..... None
See application file for complete search history.

(56) References Cited

U.S. PATENT DOCUMENTS

| | | | | |
|---|---|---|---|---|
| 2004/0135833 | A1 | 7/2004 | Mitsuzawa | |
| 2004/0232611 | A1 | 11/2004 | Fujioka | |
| 2005/0078145 | A1* | 4/2005 | Inoue | 347/31 |
| 2005/0212835 | A1* | 9/2005 | Konno | 347/6 |
| 2009/0085947 | A1 | 4/2009 | Kado | |
| 2009/0219372 | A1* | 9/2009 | Igi et al. | 347/104 |

FOREIGN PATENT DOCUMENTS

| | | | |
|---|---|---|---|
| CN | 1373044 | A1 | 10/2002 |
| JP | 05278278 | A | 10/1993 |
| JP | 3070234 | B | 5/2000 |
| JP | 20070276292 | A | 10/2007 |

* cited by examiner

*Primary Examiner* — Stephen Meier

*Assistant Examiner* — Tracey McMillion

(74) *Attorney, Agent, or Firm* — Canon U.S.A., Inc IP Division

(57) ABSTRACT

There is provided an apparatus capable of obtaining an image with good quality even if platen suction pressure for reducing sheet floatation is different. The apparatus includes a conveyance unit configured to convey a recording medium, a platen configured to hold the recording medium at a position facing the recording head, a generation unit configured to generate power to attract the recording medium on the platen, and a control unit configured to correct a drive amount of the conveyance unit based on the generated power.

20 Claims, 9 Drawing Sheets

INKJET RECORDING APPARATUS AND RECORDING MEDIUM CONVEYANCE METHOD FOR THE INKJET RECORDING APPARATUS

BACKGROUND OF THE INVENTION

1. Field of the Invention

The present invention relates to an inkjet recording apparatus and a recording medium conveyance method for the inkjet recording apparatus.

2. Description of the Related Art

Conventional inkjet recording apparatuses are provided with an upstream side conveyance unit that performs conveyance of a recording medium at an upstream side in the conveyance direction and a downstream side conveyance unit that performs conveyance of the recording medium at a downstream side in the conveyance direction.

Generally, the upstream and downstream conveyance units include a driving roller and a pinch roller that is arranged at a position facing the driving roller and is elastically urged to the driving roller by a pressing unit such as a spring.

The driving roller at the upstream side is also referred to as a conveyance roller. The conveyance roller is a metallic roller formed to have fine uneven shapes on the surface to produce a large frictional force. The driving roller at the downstream side is also referred to as a discharge roller. For the roller, generally, a roller that is formed of a material having a large frictional force such as rubber is used.

For the purpose to prevent slack of a recording medium, as compared to the conveyance roller, the diameter of the discharge roller is set to increase the speed by 0.3 to 1%. In the setting, the holding force at the downstream side conveyance unit is smaller than that at the upstream side conveyance unit. Accordingly, when the recording medium is nipped by the both units, the recording medium is conveyed in a state that slip is generated at the side of the downstream side conveyance unit.

In the inkjet recording apparatus, ink is perpendicularly discharged from a discharge port face of the inkjet head. However, due to various factors, the discharging direction may be tilted, and may cause deviation in ink impact positions. This deteriorates the image quality. In such a case, the shorter the distance (nozzle height) between the discharge port face and the recording medium is, the smaller the impact position deviation is. However, if the nozzle height is lowered, due to curl (distortion) or flotation of the recording medium, ruffling caused by ink absorption on the recording medium, and the like, the recording medium and the discharge port face may come in contact with each other. Then, the recording head may be broken, or the recording medium may be stained with the ink.

In order to regulate the flotation of the recording medium, a suction platen is employed. The suction platen is made by forming many suction holes on a recording medium contact surface of a suction box that is formed in a box shape. By exhausting air from the inside of the platen using a fan, negative pressure is produced. By the pressure, the recording medium can be attracted and held on the recording medium contact surface of the platen.

For example, Japanese Patent Application Laid-Open No. 2007-276292 discusses a control method, in which a humidity sensor is provided in a printer, and based on a detected humidity, a negative pressure produced via a platen is controlled to be changed. In this technique, in an environment where paper flotation is large, by controlling the negative pressure to increase, the flotation of the recording medium is reduced. Then, the negative pressure is not increased more than necessary, and the power of the apparatus can be saved and the noise can be reduced.

Now, the amount of the conveyance of the recording medium is described. Conventionally, it has been known that in a state in which a conveyance load (hereinafter, referred to as back tension) is not applied, a conveyance amount of a recording medium by a conveyance roller is equals to a length of the outer circumference surface of the conveyance roller used for the conveyance.

According to the theory, if the conveyance amount of the recording medium is Lm, the outside diameter of the conveyance roller is D, and the rotation amount of the conveyance roller is θ [deg], the conveyance amount Lm of the recording medium can be expressed as follows:

$$Lm=\pi\times D\times(\theta/360)$$

When back tension is applied by the structure of the recording apparatus, between the conveyance roller and the recording medium, slip is produced. Then, the conveyance amount Lm of the recording medium may be shorter than the length of the outer circumference surface of the conveyance roller used for the conveyance. The relationship can be expressed as follows:

$$Lm\leqq\pi\times D\times(\theta/360) \quad (1)$$

It has been considered that the amount of the decrease of the conveyance amount Lm differs depending on the types of the recording media. As described above, it has been known that the conveyance amount of the recording medium is to be a movement amount equivalent to the outer diameter of the conveyance roller or slightly decreased by the slip, and the degree of the decrease differs depending on the types of the recording media.

In order to prevent the deterioration in the recording quality due to the deviation (hereinafter, referred to as conveyance error) of the conveyance amount of the recording medium, Japanese Patent No. 03070234 discusses a technique to change a feed amount of a conveyance roller using a feed correction value for each type of recording media.

By the technique to correct the conveyance amount to an optimum value depending on the types of the recording media, it is possible to correct a certain amount of conveyance error.

However, in the method for correcting the conveyance amount for each recording medium, even if the type of the recording medium is the same, if negative pressure (hereinafter, referred to as platen suction pressure) of the suction platen differs, the recording medium is not conveyed at a constant conveyance amount. Then, streak is produced on the recording image.

Especially, when the recording medium is conveyed by only the discharge roller of the downstream side that has a low holding force and the recording operation is performed, the platen suction pressure largely affects the conveyance error, and results in image deterioration.

SUMMARY OF THE INVENTION

According to an aspect of the present invention, an apparatus includes a conveyance unit configured to convey a recording medium, a platen configured to hold the recording medium at a position facing a recording head, a generation unit configured to generate power to attract the recording medium on the platen, and a control unit configured to correct a drive amount of the conveyance unit based on the generated power.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
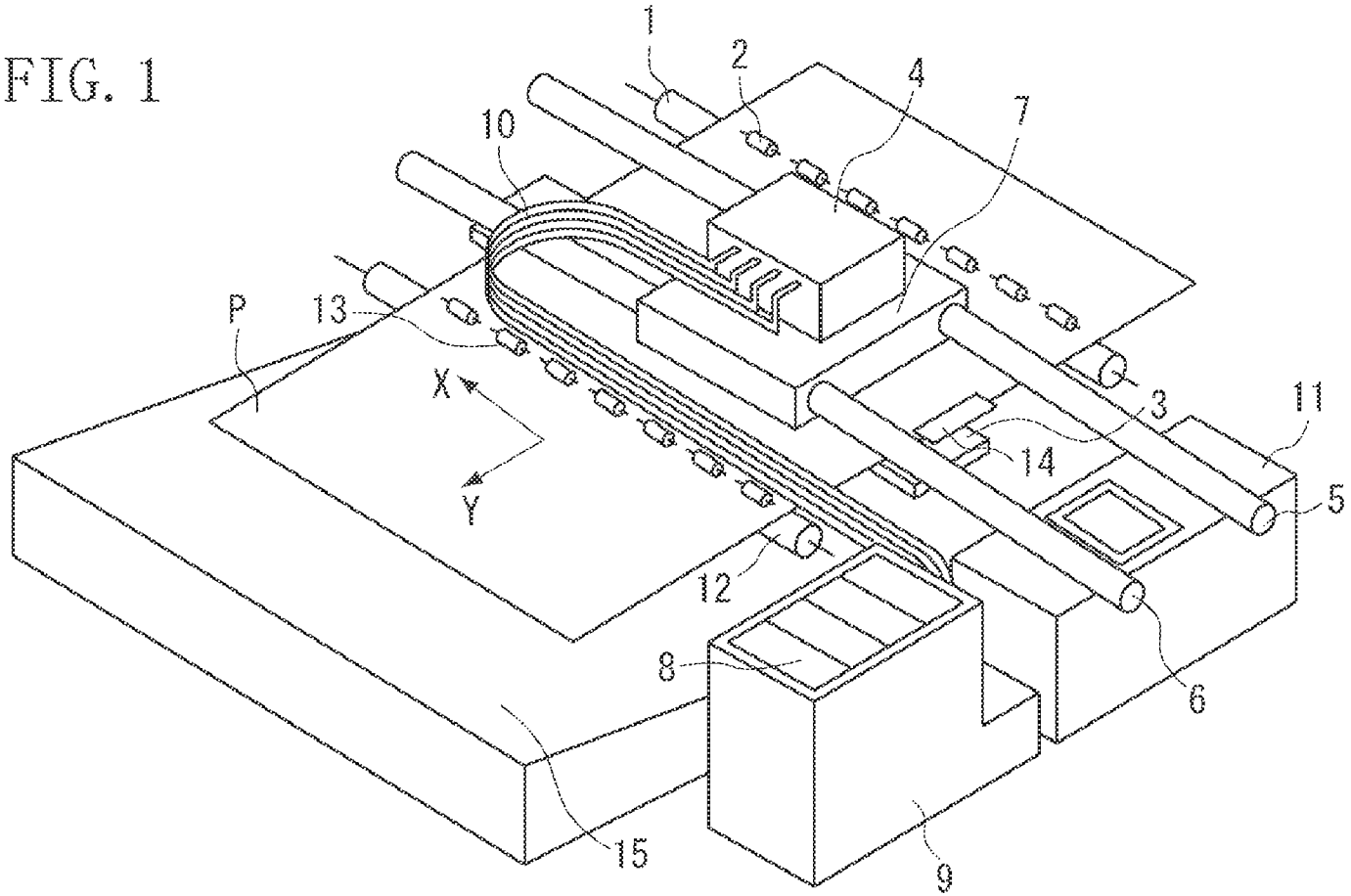
FIG. 1 is a perspective view illustrating an inkjet recording apparatus according to an exemplary embodiment of the present invention.
Figure 2:
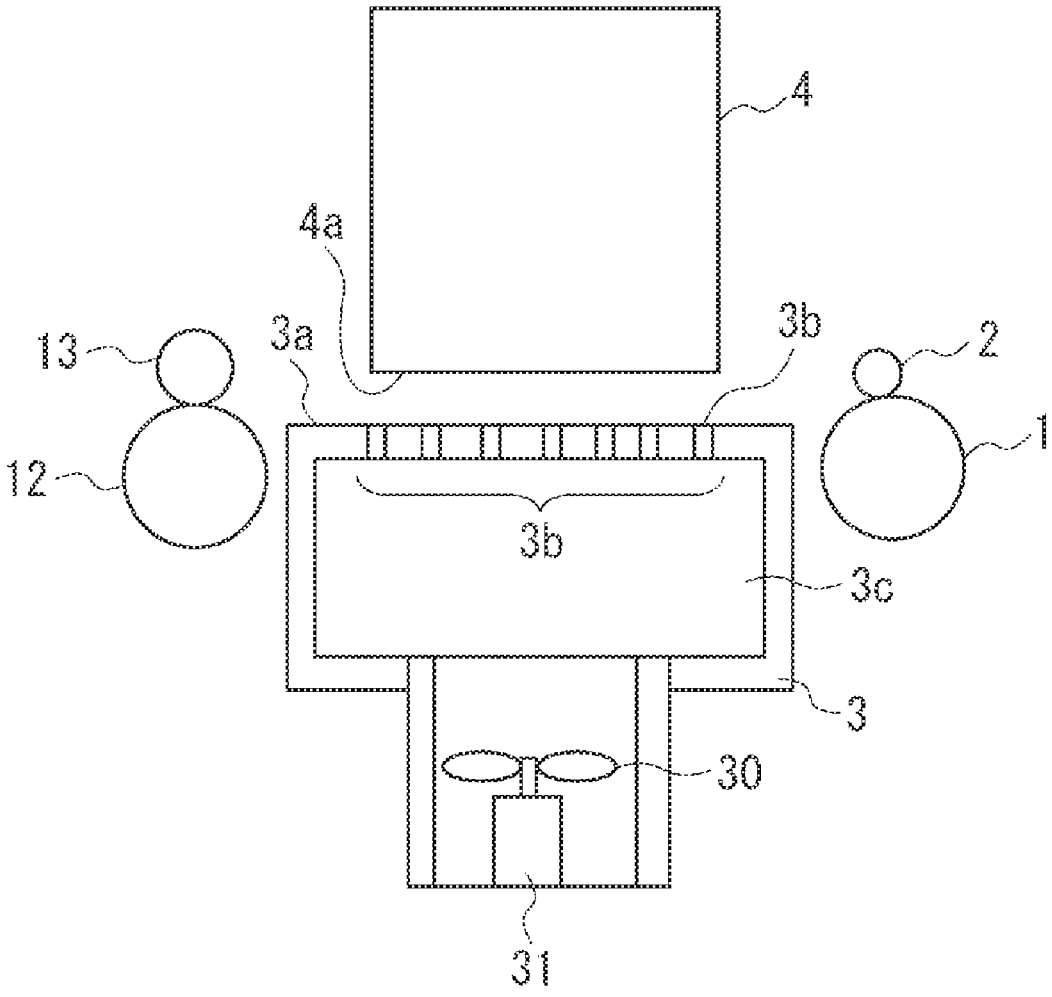
FIG. 2 is a cross sectional view illustrating the inkjet recording apparatus.

First, an outline of an inkjet recording apparatus according to an exemplary embodiment of the present invention is described. FIG. 1 is a perspective view illustrating an overall structure of the inkjet recording apparatus according to the exemplary embodiment of the present invention. FIG. 2 is a cross sectional view illustrating the inkjet recording apparatus.

In FIGS. 1 and 2, in inkjet recording, a recording medium P to be recorded thereon is nipped between a conveyance roller 1 and a pinch roller 2, which is a driven roller. By rotation of the conveyance roller 1, the recording medium P is guided and held on a platen 3, and conveyed in the allow Y direction in FIG. 1. The conveyance roller 1 is a metallic roller formed to have fine uneven shapes on the surface to produce a large frictional force. The pinch roller 2 is elastically urged toward the conveyance roller 1 by a pressing unit (not illustrated) such as a spring.

The platen 3 is arranged to face an ink discharge surface 4*a* of an inkjet head 4 that serves as a recording head. The platen 3 holds the recording medium P conveyed by the conveyance roller to be flat on a guiding surface 3*a*. The guiding surface 3*a* has a plurality of openings 3*b*, and communicates with a space 3*c* in the lower inside of the platen 3 by air paths.

When the space 3*c* in the lower inside of the platen 3 is negatively pressured by a fan 30 that is a suction power generation unit, by the negative pressure, the recording medium P is attracted on the guiding surface of the platen through the openings 3*b*. By the mechanism, the recording medium P can maintain a certain degree of flatness. A fan motor 31 drives the fan 30. The suction power generation unit can be a pump.

The recording medium P conveyed on the platen 3 is then nipped between a discharge roller 12 that is rotating and a spur 13 that is a rotating member driven by the discharge roller 12, and conveyed. The discharge roller 12 is a rubber roller that has a large frictional force. The spur 13 is elastically urged toward the discharge roller 12 by a pressing unit (not illustrated) such as a spring. To prevent damaging or denting the surface of the recording medium P after an image is recorded, the pressure of the spur 13 is set to a pressure of about one-tenth of the pressure of the pinch roller 2. For the purpose to prevent slack of the recording medium P, as compared to the conveyance roller 1, the diameter of the discharge roller 12 is set to increase the speed by about 1%.

When the recording medium P is nipped by both of the conveyance roller 1 and the pinch roller 2, and the discharge roller 12 and the spur 13, due to the difference in the holding force, the recording medium P is conveyed in a state where a slip is produced between the discharge roller 12. After the image recording is performed, by the rotation of the discharge roller 12, the recording medium P is discharged from the top of platen onto a discharge tray 15.

In order to regulate the end of the recording medium P from being floated toward the inkjet head 4 in a direction intersecting with the conveyance direction Y, over the platen 3, a recording medium holding member 14 is provided. The inkjet head 4 is detachably mounted on a carriage 7 that is reciprocated along two guide rails 5 and 6 by a driving unit such as a carriage motor 33 (see FIG. 3) in an orientation to discharge ink toward the recording medium P. The carriage movement direction is the direction intersecting with the recording medium conveyance direction (arrow Y direction), and is referred to as a main scanning direction. On the other hand, the recording medium conveyance direction is referred to as a sub scanning direction.

Figure 3:
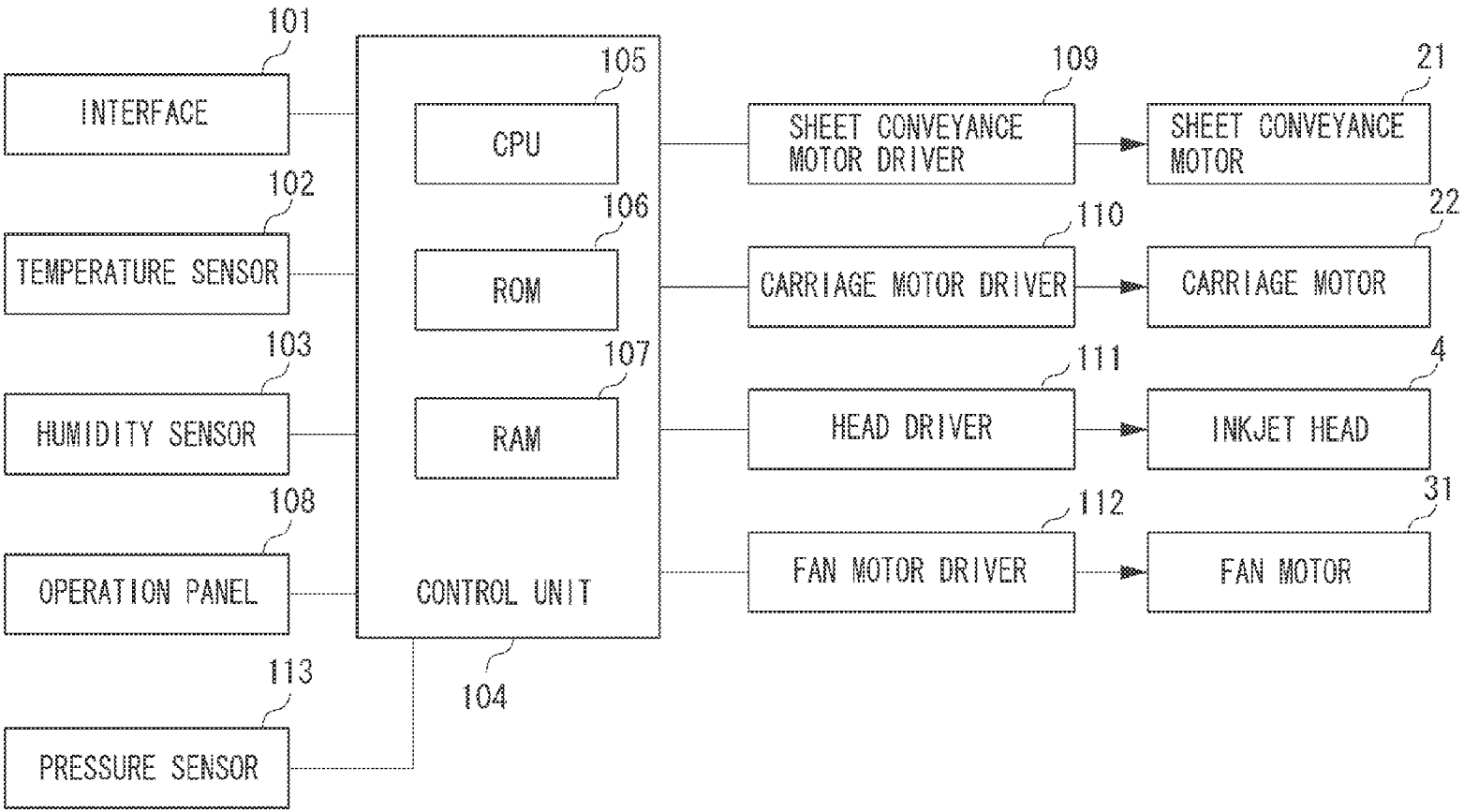
FIG. 3 is a block diagram illustrating a control system.

Now, a control configuration for implementing the inkjet printer of the above-described apparatus is described with reference to the block diagram in FIG. 3.

An interface 101 is used to input image data from an external personal computer, or the like. The configuration includes a temperature sensor 102 for detecting temperature in a usage environment of the inkjet printer and a humidity sensor 103 for detecting humidity.

A control unit 104 includes a central processing unit (CPU) 105, a read-only memory (ROM) 106 that stores control programs to be implemented by the CPU 105 and fixed data in a non-volatile way, and a random access memory (RAM) 107 that serves as a work area at program implementation and stores various parameters. At least a part of the area of the RAM 107 is a battery backup memory to store data after the power of the printer is turned off. Instead of the memory, a nonvolatile rewritable memory such as a flash memory can be used.

The inkjet recording apparatus also includes a sheet conveyance motor driver 109 that drives a sheet conveyance motor 21 that drives the conveyance roller 1 and the discharge roller 12, and a carriage motor driver 110 that drives a carriage motor 22 that performs scanning of the carriage 7. A head driver 111 drives the inkjet head 4, and a fan motor driver 112 drives the fan motor 31.

The control unit 104 carries out calculation and processing of various signals and data input from the interface 101, the temperature sensor 102, the humidity sensor 103, and an operation panel 108. Based on the processing results of the signals and data, the control unit 104 gives a drive signal to the sheet conveyance motor driver 109, the carriage motor driver 110, the head driver 111, and the fan motor driver 112.

A pressure sensor 113 detects suction pressure of the platen. The pressure sensor 113 detects pressure in the space 3*c* in the platen 3.

In response to a print instruction, print operation is started. First, environment conditions detected by the temperature sensor, the humidity sensor, and the like, and each condition setting in the print instruction that is input by the user, are recognized. In the present exemplary embodiment, the humidity sensor 103 is provided in the body, and based on the result detected by the humidity sensor 103, the platen suction pressure is controlled. As described above, even if paper of the same type is used, the platen suction pressure for regulating floatation from the platen differs depending on usage environments (temperature and humidity) of the printer.

Figure 4:
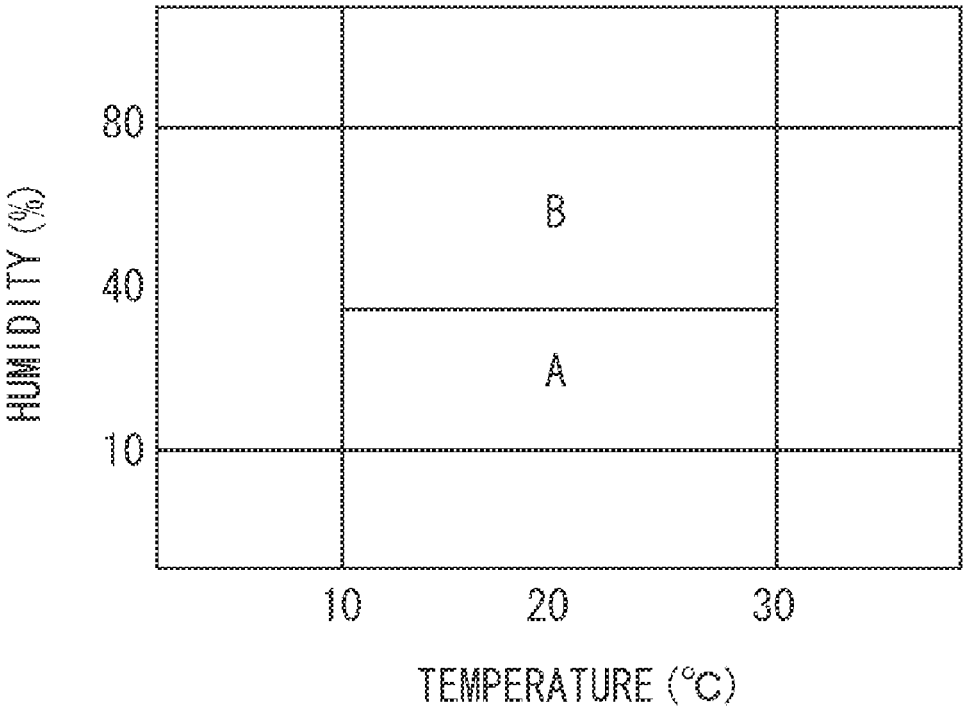
FIG. 4 illustrates ranges of temperature and humidity in which exemplary embodiments of the present invention can be applied.

FIG. 4 illustrates the temperature and humidity environment in which the inkjet recording apparatus is used. For example, when the inkjet recording apparatus is used in an environment where the temperature ranges from 10 to 30 degrees and the humidity ranges from 10 to 80%, the environment is classified in two environments of a low-humidity environment A and a high-humidity environment B. In the present exemplary embodiment, humidity of less than 40% is included in the low-humidity environment A, and humidity of 40% or greater is included in the high-humidity environment B.

The table 1 illustrates each suction pressure in the above-described low-humidity environment A (in the table 1, it is illustrated as TEMPERATURE/HUMIDITY A) and the high-humidity environment B (in the table 1, it is illustrated as TEMPERATURE/HUMIDITY B). According to the classification, settings of the platen suction pressure are changed. Especially, in a low humidity and dried environment, moisture in the recording medium evaporates and the rigidity of the recording medium increases. Accordingly, under the low-humidity environment A, as compared to the high-humidity environment B, the control is performed in such a manner that larger suction pressure is used. Since the rigidity differs depending on the types of the recording media, the suction pressure is set for each type of the recording medium.

TABLE 1

| TYPES OF RECORDING MEDIA | TEMPERATURE/ HUMIDITY A SUCTION PRESSURE [KPa] | TEMPERATURE/ HUMIDITY B SUCTION PRESSURE [KPa] |
|---|---|---|
| PLAIN PAPER | 0.3 | 0.2 |
| GLOSSY PAPER | 0.2 | 0.2 |
| FILM | 0.3 | 0.2 |
| COATED PAPER | 0.4 | 0.2 |

Now, print operation performed by the inkjet recording apparatus by scanning in the printing X direction illustrated in FIG. 1 is described with reference to FIG. 5. The inkjet head 4 has arrays of ink discharge nozzles, for example, arrays of linearly-arranged 128 nozzles. The inkjet head 4 that is mounted on the carriage 7 performs image printing by discharging ink on the recording medium in the allow X direction.

Figure 5:
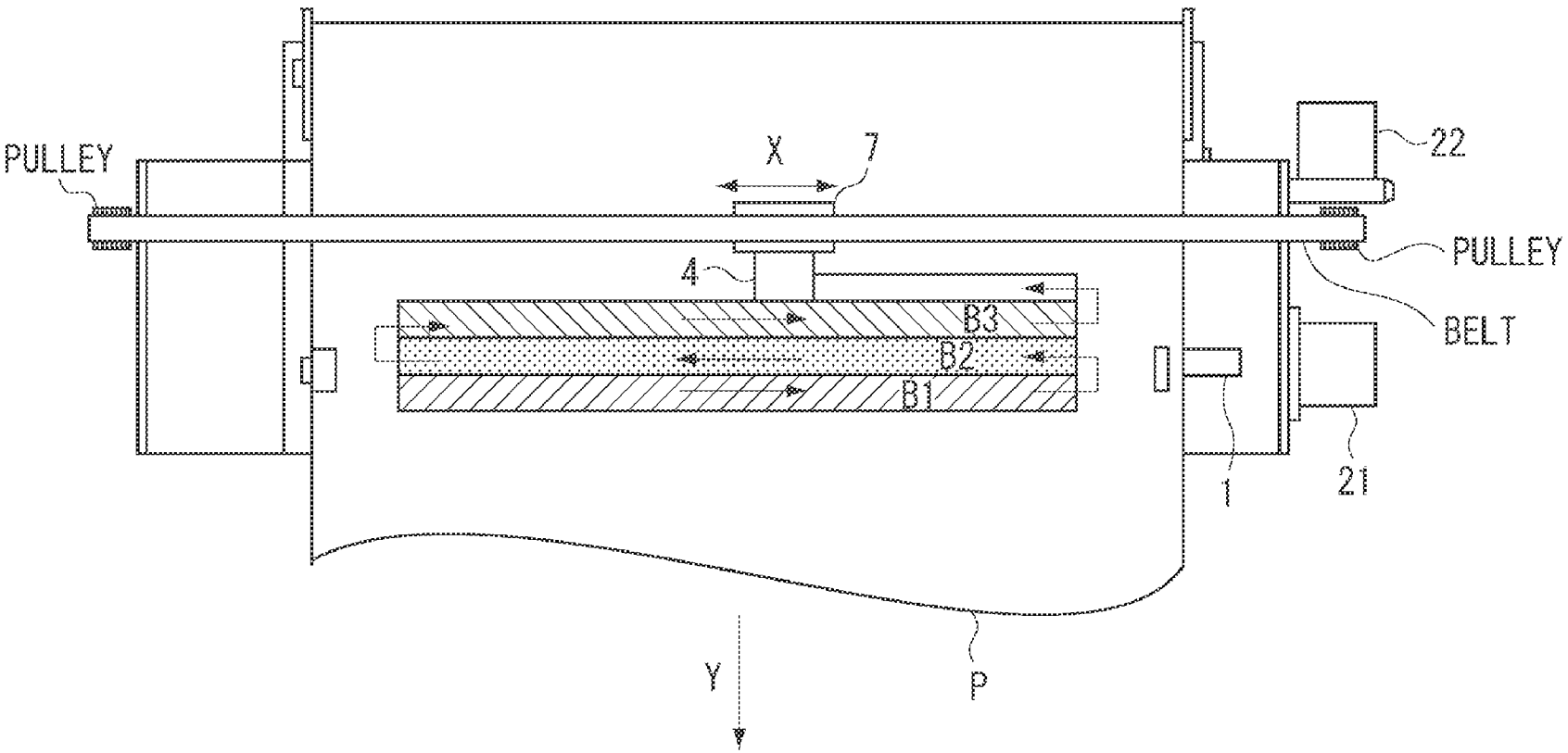
FIG. 5 illustrates printing operation.

In the present exemplary example illustrated in FIG. 5, first, the carriage 7 is scanned to the right in FIG. 5. Then, according to the printing information of the band, from the nozzle arrays of the inkjet head 4, ink droplets are continuously discharged to perform printing of the area of a band B1. When the inkjet head 4 arrives at the right end in the printing area, the recording medium P is fed in the arrow Y direction by the width of the printing of the band B1. Then, the inkjet head 4 is returned, and performs printing of a band B2.

Similarly, such an operation is repeated to form the whole image. That is, the whole image is formed by the sets of the printed bands. In the operation, for each band printing completion, before the next band printing, the recording medium P is to be fed by one band by the sheet conveyance motor 21. The bands B1 and B2 are set depending on the type of the recording medium P.

However, in the system that has the suction platen, the platen suction pressure works as back tension to the recording medium. Even if recording media of the same type is used, if the platen suction pressure is different, the conveyance errors are different to each other. This causes deterioration in images. To solve the situation, in the present exemplary embodiment, feed correction according to each platen suction pressure is performed.

The present exemplary embodiment is described with reference to the table illustrated in table 2 and the flowchart illustrated in FIG. 6.

Table 2 illustrates correction values that are set for each corresponding type of recording medium and suction pressure.

At the designing phase, for each of the type of the recording medium and fan suction pressure, a conveyance amount of the recording medium is measured. Then, depending on an amount of the conveyance amount that the recording medium did not arrive to a target position, a feed correction value of a rotation amount of the roller is determined. Then, a table such as the table 2 is created, and the feed correction value is written, and the table is written in the ROM 106 that serves as a data storage unit.

TABLE 2

| TYPES OF RECORDING MEDIA | SUCTION PRESSURE [KPa] | FEED CORRECTION VALUE [μm] |
|---|---|---|
| PLAIN PAPER | 0.2 | 15 |
| | 0.3 | 20 |
| | 0.35 | 23 |
| GLOSSY PAPER | 0.15 | 8 |
| | 10 | 10 |
| | 0.3 | 13 |
| FILM | 0.2 | 25 |
| | 0.3 | 30 |
| | 0.4 | 36 |
| COATED PAPER | 0.2 | 20 |
| | 0.4 | 25 |
| | 0.5 | 35 |

Figure 6:
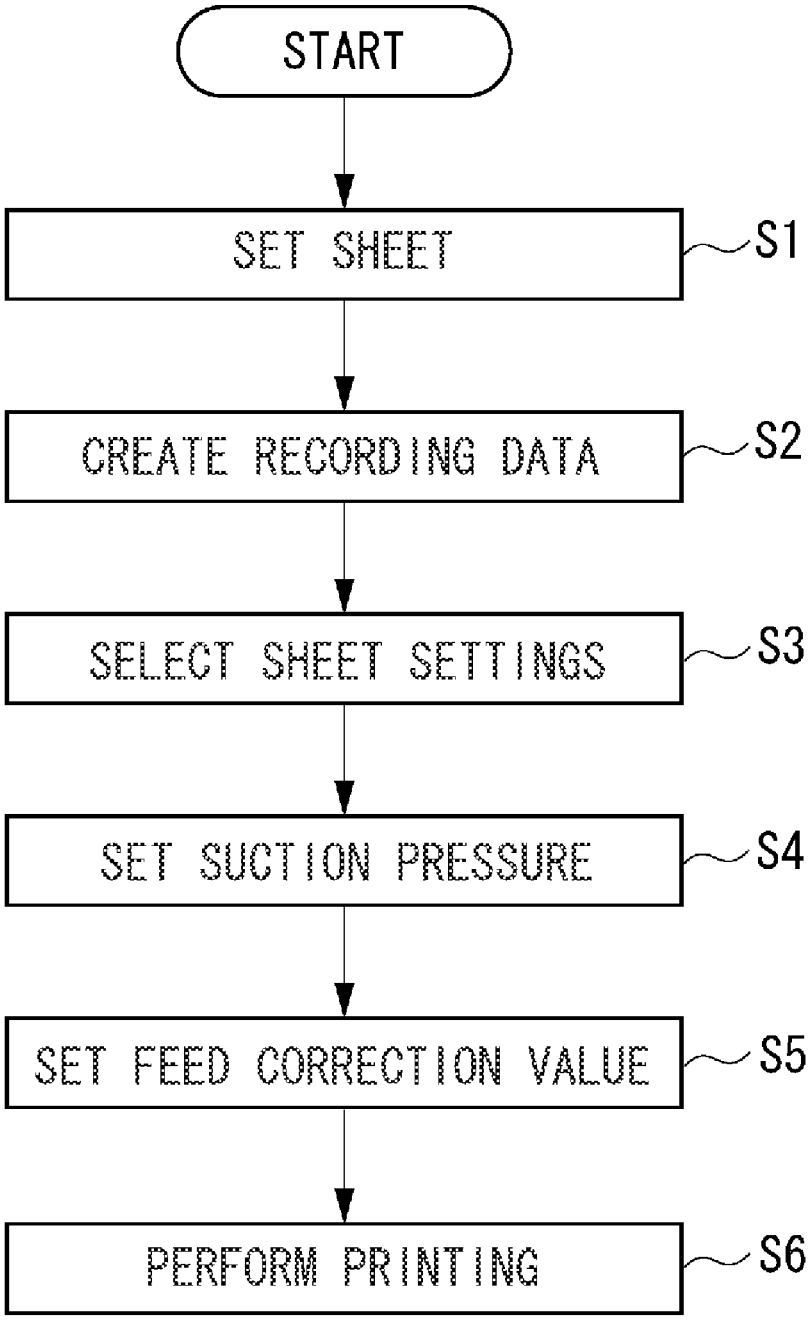
FIG. 6 is a flowchart illustrating operation according to an exemplary embodiment of the present invention.

FIG. 6 is a flowchart illustrating control according to the present exemplary embodiment.

In step S1, the recording medium P is set. In step S2, recording data is created by a personal computer. In step S3, the recording medium (glossy paper, mat paper, plain paper, etc.) that is actually used for printing, and a print mode (printing speed, the number of paths, etc.) are selected. By implementing the operation in steps S2 and S3, an image signal and the selected results are sent from a personal computer (PC) to the control unit in the printer.

In step S4, a table such as table 2 stored in the ROM 106 that serves as the data storage unit is referred to, and based on the suction power setting value, a suction pressure is set. In step S5, a feed correction value corresponding to the suction pressure is set.

Based on the correction value, the sheet conveyance unit is controlled. That is, if no slip exists, a theoretical value of the rotation amount θ [deg] of the conveyance roller for conveying the recording medium by the conveyance amount Lm can be obtained as follows:

$$Lm=\pi D(\theta/360) \quad (2)$$

Accordingly, $$\theta=360Lm/(\pi D) \quad (3)$$

A rotation amount θc [deg] of the conveyance roller that is obtained by correcting the amount of the slip using a correction value A (it is converted so as to have the same unit as D) acquired from the table 2 can be expressed as follows:

$$\theta c=\theta+360A/(\pi D)=360(Lm+A)/(\pi D) \quad (4)$$

As described above, while reducing the flotation by the platen suction pressure according to the environment, the print operation is performed. Further, the sheet conveyance motor 21 is controlled in such a manner that the rotation amount of the conveyance roller 1 is to be the value θc to correct the conveyance error produced by the slip.

Referring to table 2, in the recording medium of the same type, as the suction pressure increases, the correction value increases too. More specifically, if a correction value at a first suction pressure is defined as a first correction value, a second correction value at a second suction pressure that is greater than the first suction pressure is to be a value greater than the first correction value.

In other words, if a rotation amount of the conveyance roller at the first suction pressure (first suction power) is defined as a first rotation amount, a second rotation amount at the second suction pressure (second suction power) that is greater than the first suction pressure is to be a value greater than the first rotation amount. Similarly, if a drive amount of the conveyance roller at the first suction pressure is defined as a first drive amount, a second drive amount at the second suction pressure that is greater than the first suction pressure is to be a value greater than the first drive amount.

As described above, according to the present exemplary embodiment, by performing the conveyance system control in consideration of the fan suction pressure, the correction with the increased conveyance accuracy can be performed, and high image quality can be realized. So far, in the above description, it has been described that a rotation amount of a roller is corrected. However, if the rotation amount is converted into a conveyance amount (conveyance distance) of the conveyance unit, it is also possible to describe that the conveyance amount is corrected.

Further, the control unit 104 controls a rotation amount of a roller by controlling a drive amount (rotation amount) of a motor or a drive source. Accordingly, if the rotation amount is converted into the drive amount of the motor, it is also possible to describe that the drive amount of the motor is corrected.

Further, in the above description, referring to table 2, a feed correction value corresponding to a setting value of the suction pressure is selected. The setting value can be referred to as a control target value. The pressure sensor 113 detects an actual suction pressure. Based on the information, the control unit 104 feedback-controls the fan motor driver 112 so that the actual suction pressure becomes close to the setting value or the suction pressure is to be within a predetermined range having the setting value as the median value.

Further, without using the setting value, a correction value corresponding to suction pressure detected by the pressure sensor 113 can be selected.

Figure 7:
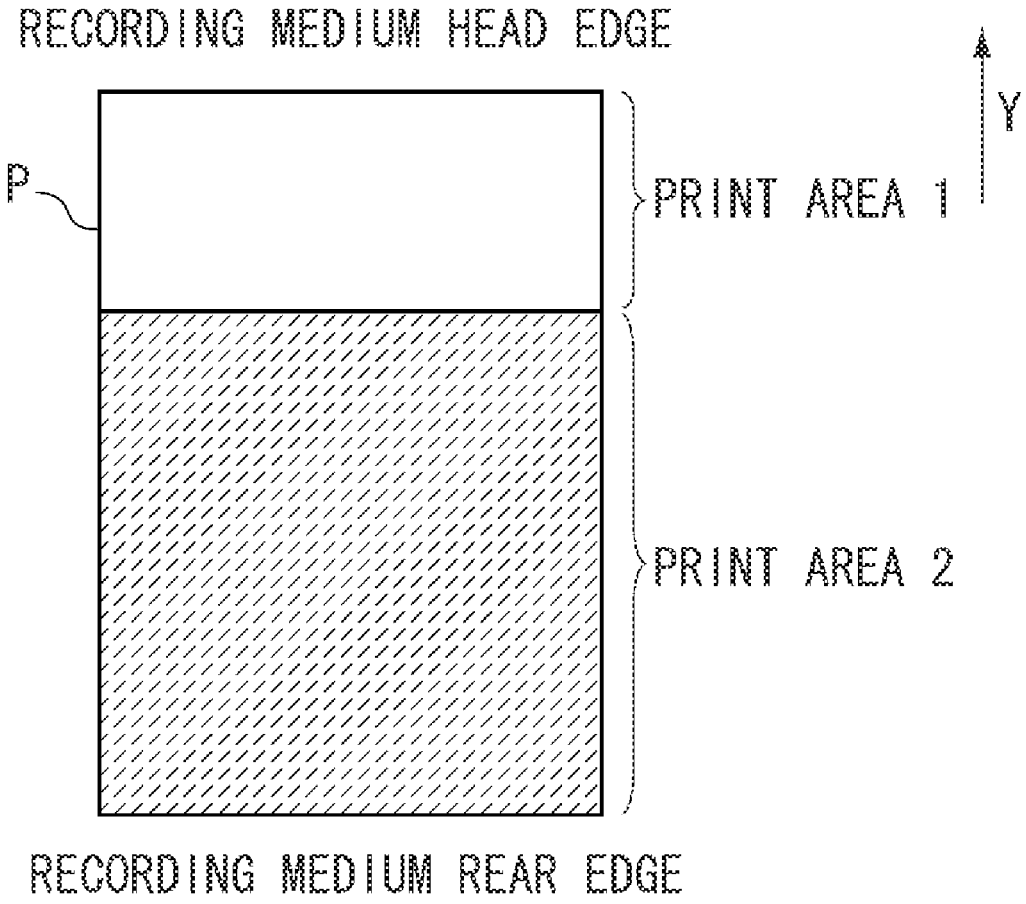
FIG. 7 illustrates a switching point of suction pressure.

Table 3 illustrates transition of platen suction pressure from the time of the sheet feeding operation to the time of the sheet discharging operation. FIG. 7 illustrates a switching point of the platen suction pressure.

In the present exemplary embodiment, it is defined that the conveyance roller 1 and the pinch roller 2 that are arranged at the upstream side of the inkjet head 4 are a first conveyance unit, and the discharge roller 12 and the spur 13 that are arranged at the downstream side of the inkjet head 4 are a second conveyance unit. Combinations of the conveyance units in the conveyance of the recording medium are changed from the time of the sheet feeding to the time of the sheet discharging.

As illustrated in FIG. 7, when the head edge of the recording medium is not nipped by the discharge roller 12 and the spur 13, the recording medium tends to float from the platen 3. Accordingly, when the recording medium is set to a print starting position or the recording is performed in a state that the head edge of the recording medium is not nipped by both of the discharge roller 12 and the spur 13 at the same time, the suction pressure is increased (negative pressure is increased) to stabilize the behavior of the recording medium. For example, in the print area 1 in FIG. 7, the recording is performed in the state that the recording medium is not nipped by the discharge roller 12 and the spur 13.

Table 3 illustrates an example of the control of changing the platen suction pressure to stabilize the behavior of the recording medium when the recording medium is not nipped by both of the conveyance roller 1 and the pinch roller 2 and the discharge roller 12 and the spur 13 at the same time.

Referring to Table 3, since the head edge of the recording medium tends to float from the platen, during the sheet feeding operation or recording onto the print area 1, the recording medium is attracted by high suction pressure. When the recording medium is conveyed by a certain distance and the recording is performed in a print area 2, the recording medium is nipped by both of the conveyance roller 1 and the pinch roller 2, and the discharge roller 12 and the spur 13. Then, the suction pressure is decreased.

Further, in the sheet discharging operation in which the recording medium is nipped by only the discharge roller 12 and the spur 13, the suction pressure is increased. As described above, depending on the combinations of the conveyance units in the conveyance, the suction power is changed.

The sequence illustrating such a relationship is stored in the ROM 106 that works as the data storage unit.

Then, while table 3 and table 2 stored in the data storage unit ROM 106 are referred to, the sheet conveyance control is performed using correction values corresponding to the sequence.

TABLE 3

| | PLATEN SUCTION PRESSURE [KPa] |
|---|---|
| SHEET FEEDING OPERATION | 0.4 |
| PRINT AREA 1 | 0.3 |
| PRINT AREA 2 | 0.25 |
| SHEET DISCHARGING OPERATION | 0.35 |

In addition to the above-described structure, a recording medium conveyance method in a case where more than one roller is provided is described.

Figure 8:
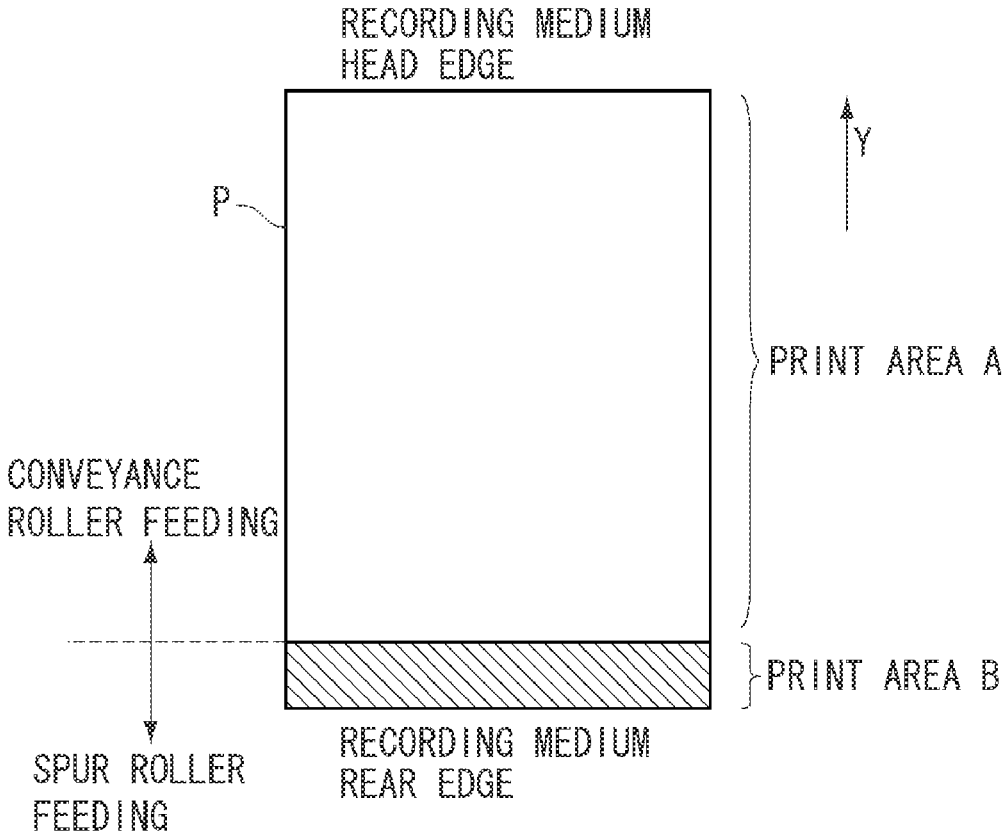
FIG. 8 illustrates an example of areas of two types according to an exemplary embodiment of the present invention.
Figure 9A:
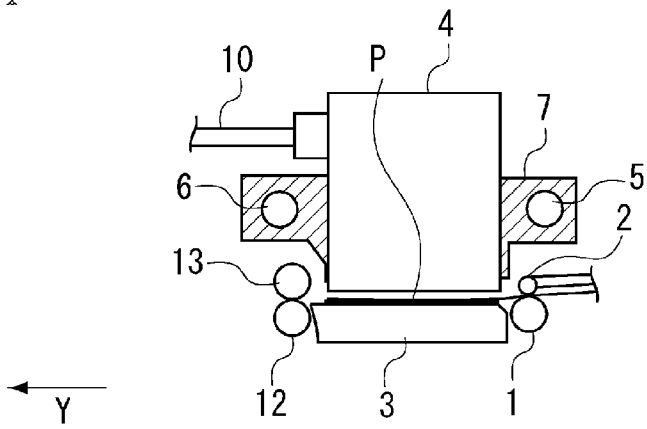
FIGS. 9A, 9B, and 9C illustrate positional relationships among a recording medium, a conveyance roller, and a discharge roller during conveyance of the recording medium according to an exemplary embodiment of the present invention.
Figure 9B:
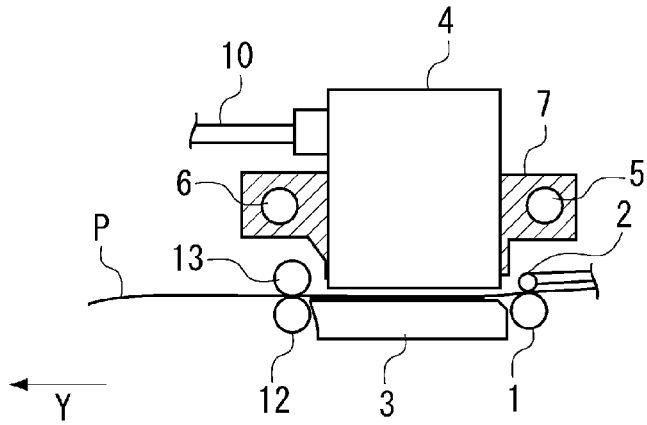
Figure 9C:
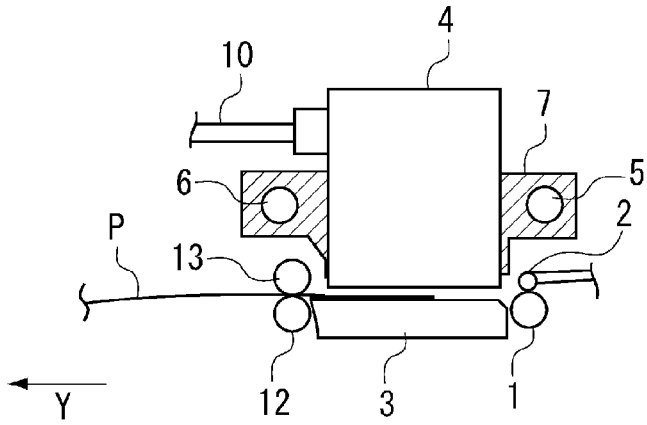

FIG. 8 illustrates an example of division of areas of two types according to the present exemplary embodiment. FIGS. 9A, 9B, and 9C illustrate positional relationships among the recording medium, the conveyance roller, the discharge roller, and the platen in a process of recording medium conveyance.

The area A in FIG. 8 is an area where the recording is performed in a state that the recording medium P is conveyed by only the conveyance roller 1 as illustrated in FIG. 9A or in a state that the recording medium P is conveyed by the two rollers of the conveyance roller 1 and the discharge roller 12 as illustrated in FIG. 9B. As described above, the holding force of the conveyance roller 1 and the pinch roller 2 is sufficiently larger than the holding force of the discharge roller 12 and the spur 13. Accordingly, the conveyance amount does not vary between the states of FIGS. 9A and 9B.

The area B in FIG. 8 is an area where the recording is performed in a state that the recording medium P is conveyed by only the discharge roller 12 as illustrated in FIG. 9C. In the area B, the holding force of the discharge roller 12 and the spur 13 is small. Accordingly, the platen suction largely affects the conveyance error.

Accordingly, two types of correspondence tables of the platen suction pressure and the conveyance amount correction values, that is, a first table used in the recording in the area A and a second table used in the recording in the area B are provided. Then, the conveyance is performed based on a conveyance amount corrected using the table corresponding to the recording area.

More specifically, the recording medium is conveyed using only the conveyance roller 1 and by correcting the drive amount based on the first table. Then, the recording medium is conveyed using both of the conveyance roller 1 and the discharge roller 12 at the same time by correcting the drive amount based on the first table. Then, the recording medium is conveyed using only the discharge roller 12 and by correcting the drive amount based on the second table.

In the present exemplary embodiment, two rollers are used. However, if more than one roller is used, for each roller, a feed correction value table is provided. Further, depending on various combinations of the rollers used in the feeding of the recording medium, each corresponding feed correction value table is to be provided.

In the above-described exemplary embodiment, as the suction power generation unit, the fan that generates negative pressure is employed. However, as the suction power generation unit, an electrostatic attraction system can be employed. In the electrostatic attraction system, the suction power generation unit charges the platen to generate electrostatic attractive force in order to attract the recording medium to the platen. It is also possible to charge electrodes to generate electrostatic attractive force and by the electrostatic attractive force, the recording medium is attracted to the platen.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-172919 filed Jul. 24, 2009, which is hereby incorporated by reference herein in its entirety.

What is claimed is:

1. An apparatus comprising:

a conveyance unit configured to convey a recording medium;

a platen configured to guide the recording medium at a position facing a recording head;

a generation unit configured to generate power to attract the recording medium on the platen; and a control unit configured to correct a drive amount of the conveyance unit based on the generated power generated by the generation unit.

2. The apparatus according to claim 1, wherein the control unit is configured to drive the conveyance unit at a first drive amount when the generated power is a first power, and drive the conveyance unit at a second drive amount that is greater than the first drive amount when the generated power is a second power.

3. The apparatus according to claim 1, wherein the generation unit changes the power according to an area of the recording medium where the recording is being performed.

4. The apparatus according to claim 1, wherein the control unit has a table in which the generated power and a correction value of the drive amount are associated, and corrects the drive amount using the table.

5. The apparatus according to claim 1, wherein more than one conveyance unit is provided, and the generation unit changes the power based on a combination of the conveyance units used in the conveyance of the recording medium.

6. The apparatus according to claim 5, wherein the conveyance units include a first conveyance unit that is positioned at an upstream side of the recording head and a second conveyance unit that is positioned at a downstream side of the recording head, wherein, the control unit has a first table in which the generated power when the recording medium is conveyed by only the first conveyance unit and when the recording medium is conveyed by both of the first and second conveyance units at a same time, and correction values of drive amounts of the first and second conveyance units are associated, and a second table in which the generated power when the recording medium is conveyed by only the second conveyance unit, and correction values of drive amounts of the second conveyance unit are associated.

7. The apparatus according to claim 1 further comprising:

a sensor configured to detect the generated power, wherein, based on the detected power, the drive amount of the conveyance unit is corrected.

8. The apparatus according to claim 1, wherein the control unit sets the power based on the type of the recording medium, controls the generation unit to generate the set power, and based on the set power, corrects the drive amount of the conveyance unit.

9. The apparatus according to claim 1, wherein the generation unit generates negative pressure for attracting the recording medium to the platen.

10. The apparatus according to claim 1, wherein the generation unit generates electrostatic attractive force for attracting the recording medium to the platen.

11. A method for an apparatus including a conveyance unit configured to convey a recording medium and a platen configured to guide the recording medium at a position facing a recording head, the method comprising:

generating a power to attract the recording medium on the platen by a generation unit; and correcting a drive amount of the conveyance unit based on the generated power.

12. The method according to claim 11, further comprising:

driving the conveyance unit at a first drive amount when the generated power is a first power; and driving the conveyance unit at a second drive amount that is greater than the first drive amount when the generated power is a second power.

13. The method according to claim 11, further comprising changing the power according to an area of the recording medium where the recording is being performed.

14. The method according to claim 11, wherein the control unit has a table in which the generated power and a correction value of the drive amount are associated, and corrects the drive amount using the table.

15. The method according to claim 11, further comprising:

providing more than one conveyance unit; and changing the power based on a combination of the conveyance units used in the conveyance of the recording medium.

16. The method according to claim 15, further comprising:

positioning a first conveyance unit at an upstream side of the recording head; and positioning a second conveyance unit at a downstream side of the recording head, wherein, the control unit has a first table in which the generated power when the recording medium is conveyed by only the first conveyance unit and when the recording medium is conveyed by both of the first and second conveyance units at a same time, and correction values of drive amounts of the first and second conveyance units are associated, and a second table in which generated power when the recording medium is conveyed by only the second conveyance unit, and correction values of drive amounts of the second conveyance unit are associated.

17. The method according to claim 11 further comprising:

detecting the generated power; and correcting the drive amount of the conveyance unit based on the detected power.

18. The method according to claim 11, further comprising:

setting the power based on the type of the recording medium;

controlling the generation unit to generate the set power; and correcting the drive amount of the conveyance unit based on the set power.

19. The method according to claim 11, further comprising generating negative pressure for attracting the recording medium to the platen.

20. The method according to claim 11, further comprising generating electrostatic attractive force for attracting the recording medium to the platen.

* * * * *